US011293235B2

(12) United States Patent
Olander

(10) Patent No.: US 11,293,235 B2
(45) Date of Patent: Apr. 5, 2022

(54) DIRECTIONAL DRILL STEM ROD LOADER AND METHOD

(71) Applicant: TT Technologies, Inc., Aurora, IL (US)

(72) Inventor: John A. Olander, Aurora, IL (US)

(73) Assignee: TT Technologies, Inc., Aurora, IL (US)

( * ) Notice: Subject to any disclaimer, the term of this patent is extended or adjusted under 35 U.S.C. 154(b) by 0 days.

(21) Appl. No.: 16/838,243

(22) Filed: Apr. 2, 2020

(65) Prior Publication Data

US 2020/0291729 A1 Sep. 17, 2020

Related U.S. Application Data

(63) Continuation of application No. 15/879,980, filed on Jan. 25, 2018, now Pat. No. 10,648,251.

(60) Provisional application No. 62/450,325, filed on Jan. 25, 2017.

(51) Int. Cl.

| | |
|---|---|
| ***E21B 19/15*** | (2006.01) |
| ***E21B 19/24*** | (2006.01) |
| ***E21B 15/04*** | (2006.01) |
| ***E21B 19/16*** | (2006.01) |
| ***E21B 7/04*** | (2006.01) |
| ***E21B 7/02*** | (2006.01) |

(52) U.S. Cl.

CPC ..... *E21B 19/155* (2013.01); *E21B 7/02* (2013.01); *E21B 7/04* (2013.01); *E21B 7/046* (2013.01); *E21B 15/045* (2013.01); *E21B 19/15* (2013.01); *E21B 19/16* (2013.01); *E21B 19/24* (2013.01)

(58) Field of Classification Search

CPC ..... E21B 19/155; E21B 7/02; E21B 7/046; E21B 19/15; E21B 19/24; E21B 15/045; E21B 19/16; E21B 7/04

See application file for complete search history.

(56) References Cited

U.S. PATENT DOCUMENTS

| | | | | |
|---|---|---|---|---|
| 1,364,582 | A * | 1/1921 | Reed | E21B 19/161 81/90.2 |
| 6,223,837 | B1 * | 5/2001 | Lanzl | E21B 19/15 173/164 |
| 6,311,788 | B1 * | 11/2001 | Weixler | E21B 19/15 166/77.51 |
| 6,360,830 | B1 | 3/2002 | Price | |
| 6,550,547 | B1 | 4/2003 | Payne et al. | |
| 7,600,584 | B2 * | 10/2009 | Sewell | E21B 19/15 166/85.1 |
| 10,294,738 | B2 * | 5/2019 | Koskinen | E21B 19/087 |
| 10,648,251 | B2 * | 5/2020 | Olander | E21B 7/02 |
| 2018/0209227 | A1 | 7/2018 | Olander | |

OTHER PUBLICATIONS

"U.S. Appl. No. 15/879,980, Non Final Office Action dated Aug. 2, 2019", 13 pgs.

(Continued)

*Primary Examiner* — Kristyn A Hall
*Assistant Examiner* — Jonathan Malikasim
(74) *Attorney, Agent, or Firm* — Schwegman Lundberg & Woessner, P.A.

(57) ABSTRACT

A directional drill stem loader and associated methods are shown. In one example, the drill stem loader operates in a linear motion. In one example, a drill stem gripper is configured to move the completely to one side of a drill stem during a retraction operation.

16 Claims, 5 Drawing Sheets

(56) References Cited

OTHER PUBLICATIONS

"U.S. Appl. No. 15/879,980, Notice of Allowance dated Jan. 28, 2020", 5 pgs.
"U.S. Appl. No. 15/879,980, Response filed Oct. 31, 2019 to Non-Final Office Action dated Aug. 2, 2019", 8 pgs.

* cited by examiner

DIRECTIONAL DRILL STEM ROD LOADER AND METHOD

CLAIM FOR PRIORITY

This application is a continuation of U.S. application Ser. No. 15/879,980, filed Jan. 25, 2018, which claims the benefit of priority of U.S. Provisional Application 62/450,325, filed Jan. 25, 2017, which is hereby incorporated by reference in its entirety.

TECHNICAL FIELD

Embodiments described herein generally relate to directional drilling. Specific examples may include drill stem loaders for adding or removing segments from a drill string.

BACKGROUND

Directional drills are used for a number of types of jobs. A bore is made in the ground by piercing with a drill stem. In one use, new pipe may be drawn back through the bore that was formed. In this way, new pipe may be installed without the need to dig a trench in the ground first. For example, a utility line may be installed beneath a roadway without the need to close the road during the installation process. Progress of a directional drill stem may be monitored, and the tip of a drill stem may be steered to direct the bore over long distances. As a bore progresses, commonly, drill stem segments are added to increase a length of the drill stem until the bore reaches its intended destination. After the bore is complete, the drill stem may be retracted from the bore, and drill stem segments may be removed as the drill stem is retracted.

It is desirable to have a reliable system to add and remove segments of drill stem. It is further desirable to reduce cost of the directional drill.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1:
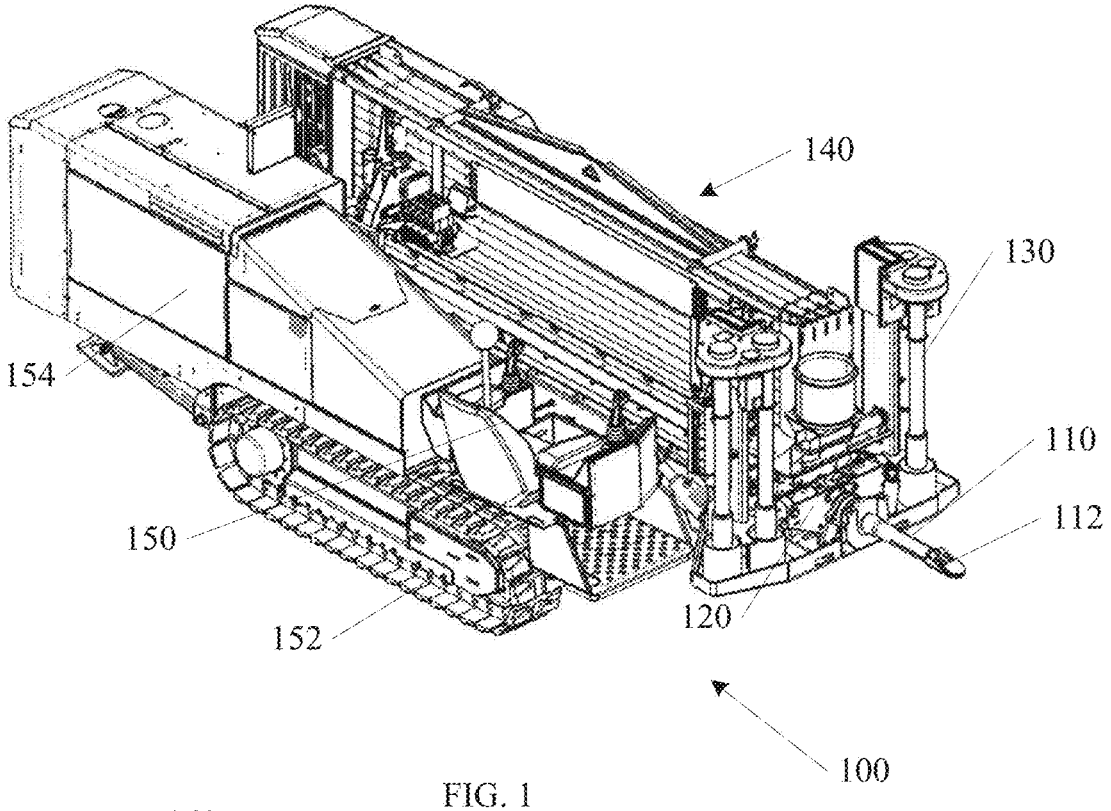
FIG. 1 is a directional drill in accordance with some embodiments of the invention.

FIG. 1 shows an example of a directional drill 100. The directional drill 100 includes a drill stem 110 including an attached sonde housing, and a drill head 112 for piercing the ground and leading a directional drill bore operation. A drill stem loader 140 is shown coupled to the directional drill 100. The drill stem loader 140 is configured to pick drill stem segments (or drill rods) from a drill stem magazine and add stem segments to the stem 110 during a boring operation. The drill stem loader 140 is further configured to remove stem segments from the drill stem 110 and replace them in the drill stem magazine after the boring operation is complete, and the drill stem is being retracted from the bore.

A power supply 154 is coupled to the directional drill 100 to drive the drill stem 110, and to operate other aspects of the directional drill 100. A cockpit 150 is further included in the directional drill 100, the cockpit 150 including a number of controllers and gauges to control and monitor a drilling operation. In on example, a track system 152 is included on the directional drill 100 to move and position the directional drill 100. A stake down system 130 is also shown coupled to a front end of the directional drill 100 in the example of FIG. 1. A drill stem vice 120 is further shown at a front end of the directional drill 100. Additional aspects of the drill stem vice 120 are described in more detail below.

Figure 2:
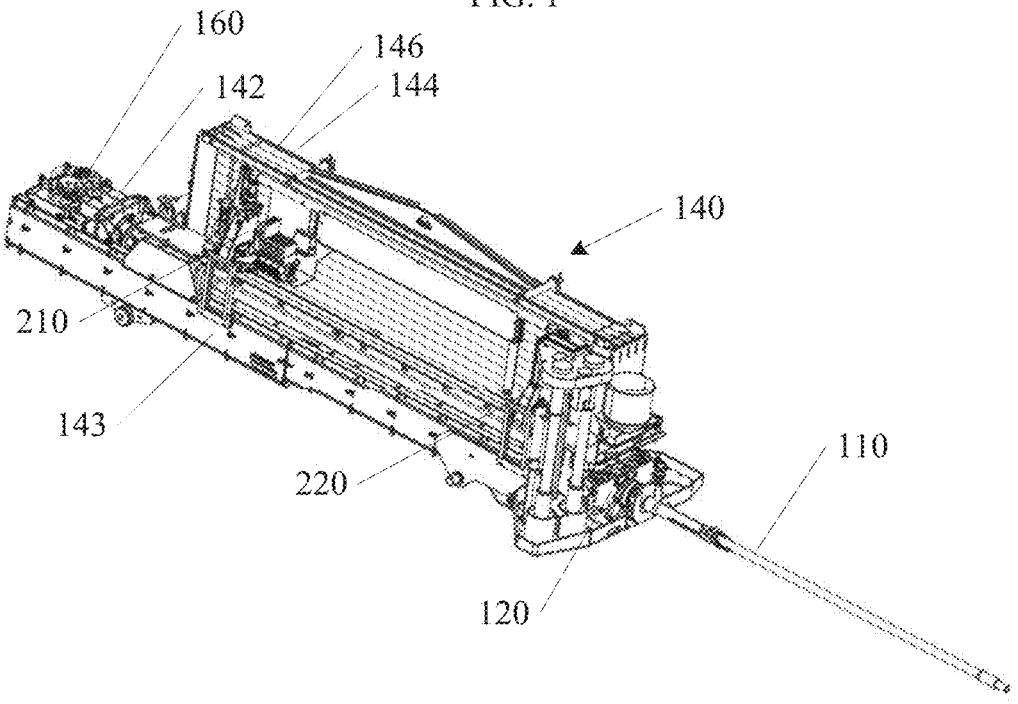
FIG. 2 is a portion of a directional drill in accordance with some embodiments of the invention.

FIG. 2 shows a portion of a directional drill 100 from FIG. 1, with a number of components removed to reveal more detail of a directional drill stem loader 140 according to an embodiment of the invention. The drill stem loader 140 includes a drill stem magazine 144, having a number of individual drill stem segments 146 loaded into the magazine 144.

A first linear actuator 210 and a second linear actuator 220 are shown adjacent to the drill stem magazine 144. In one example, the linear actuators 210, 220 are coupled to a pair of drill stem grippers as described in more detail below. Although two linear actuators are shown, the invention is not so limited. Other configurations may include a single linear actuator, or more than two linear actuators.

A drill head 142 is shown at a rear of the drill stem loader 140. The drill head 142 is mounted to a carriage frame 143 along a movable track. In one example, a drill fluid supply system 160 is coupled to the directional drill 100, adjacent to the drill head 142. During a drilling operation, the drill head 142 is operated to both rotate the drill stem 110, and to drive the drill stem 110 forward into the ground. The drill stem vice 120 is shown at a front end of the drill stem loader 140. During a drilling operation, the drill stem vice 120 selectively holds or releases individual segments of the drill stem 110 to aid in the adding or removal of drill stem segments (by screwing or unscrewing a threaded joint at either end of the drill stem segment).

Figure 3:
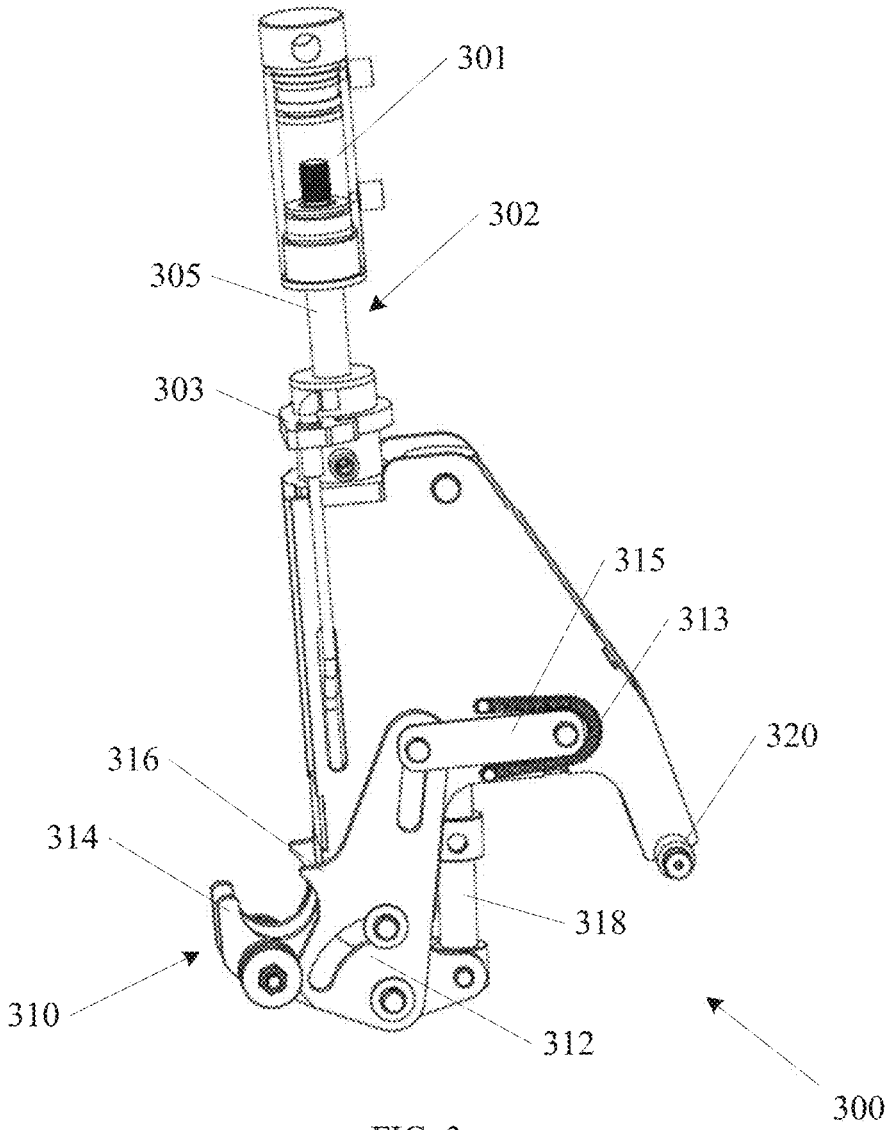
FIG. 3 is a portion of a drill stem loader in accordance with some embodiments of the invention.

FIG. 3 shows an assembly 300 that is part of a drill stem loader, similar to drill stem loader 140 shown in previous figures. The assembly 300 includes a linear actuator 302, coupled to a drill stem gripper 310. In the example shown, the linear actuator 302 includes a hydraulic cylinder, however the invention is not so limited. In the example shown in FIG. 3, the linear actuator 302 includes two hydraulic cylinders 301, 303 coupled to a common rod 305.

Other examples of linear actuators may include threaded rods, solenoids, rack and pinion systems, belt drives, etc. A guide bearing 320 is further shown in FIG. 3. In one example, a guide bearing 320 travels in a slot (not shown) to more precisely guide travel of components of the system 300 in a linear motion.

In the example shown, the drill stem gripper 310 includes a first gripper jaw 314 and a second gripper jaw 316. A linkage 312 is shown coupled to the first gripper jaw 314 and a second gripper jaw 316 and configured to actuate opposable drill stem gripper jaw motion. In the example shown, the linkage 312 is actuated by a single actuator 318 that provides the opposable jaw motion. In one example the actuator 318 is a hydraulic cylinder, however, other actuators, such as motors, solenoids, etc. may also be used.

In one example, a spring 313, or other biasing device is used to apply pressure to arm 315, which travels in a slot (not shown). The arm 315 and spring 313 configuration may be used to remove undesirable slack in the gripper jaws 314, 316 to account for wear as the jaws are used. The arm 315 and spring 313 configuration biases the second gripper jaw 316 against a drill stem segment to further enhance grip.

It is desirable to reduce complexity in a system, and to reduce manufacturing cost. It is further desirable to provide opposable jaw motion. In contrast to systems where a single jaw is actuated against an opposite fixed jaw, the present design with opposable jaw motion is capable of gripping the drill stem segment on more than 180 degrees of contact. The gripper jaws 314, 316 wrap around the drill stem from both sides to provide gripping contact. Further, the drill stem segment can be gripped in place within a drill stem magazine. The drill stem segment does not need to be dropped into the grip, or otherwise moved from its starting location within the magazine.

In one example, as shown in FIG. 3, only two actuators 302, 318 are used to operate the assembly 300. As stated above, in one example, the actuators 302, 318 are hydraulic. In such an example, a hydraulic sequencer may be used to control operation of the actuators 302, 318. Although a hydraulic sequencer is described in this example, other controllers may be used to control other types of actuators as described in examples above.

Figure 4:
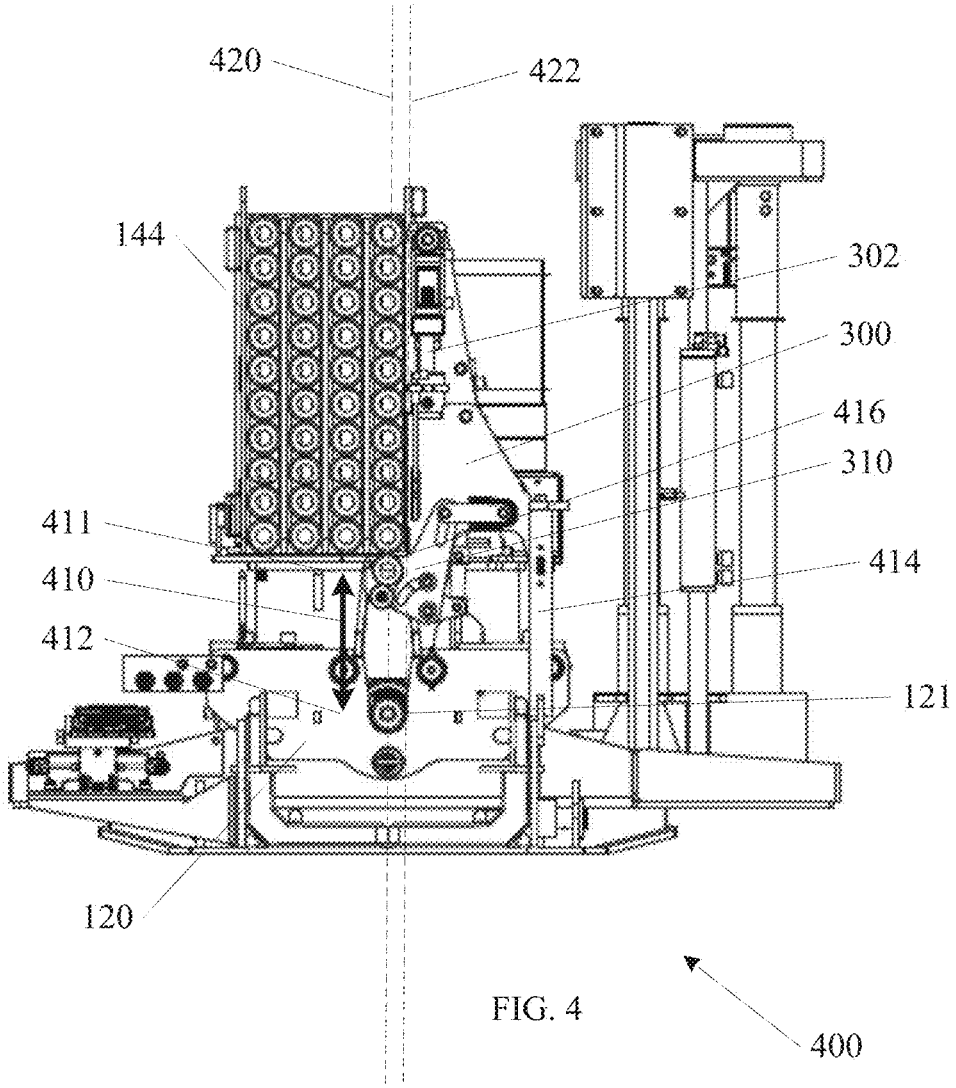
FIG. 4 is an end view of portions of a drill stem loader of a directional drill in accordance with some embodiments of the invention.

FIG. 4 shows a cross section view of an assembly 400 that includes a drill stem loader similar to drill stem loader 140. The assembly 300 is shown in context within the larger assembly 400. A track 414 is shown that guides the guide bearing 320 as described above.

In the Example of FIG. 4, the linear actuator 302 is aligned to be substantially vertical with respect to the normal orientation of the directional drill 100 shown in FIG. 4. It will be appreciated that the drill stem may be oriented at a slight angle downward as it enters the ground, and that the linear actuator 302 may be oriented parallel to the drill string. However, this orientation is still substantially vertical. In one example, the linear actuator 302 is aligned to move normal to a plane that includes the drill stem 110, wherein the plane is oriented with a zero roll angle with respect to the ground.

In FIG. 4, the drill stem gripper 310 is shown with a defined linear range of motion 410. A first end 411 of the linear range of motion 410 is shown directly beneath a dispensing port 416 of the drill stem magazine 144. A second end 412 of the linear range of motion 410 is shown within gripping jaws 121 of the drill stem vice 120. In the example shown, the drill stem gripper 310 is adapted to support a drill stem from underneath the drill stem. This configuration provides further security that while a drill stem is being gripped or being released, the drill stem gripper 310 is providing support, and keeps the drill stem segment in place until a transfer (either to the drill stem vice 120, or to the drill stem magazine 144) is complete.

In one example, a hydraulic sequencer is configured to actuate the first hydraulic cylinder 301 to drop a drill stem segment by a distance approximately equal to a diameter of one drill stem segment (one spot in the magazine 144). In one example, after the first hydraulic cylinder 301 drops the drill stem segment by a distance approximately equal to a diameter of one drill stem segment, a sliding latch (not shown) moves over within the magazine 144 and retains the remaining drill stem segments within the magazine, while allowing the selected drill stem segment to be further loaded into the drill stem vice 120.

In one example the hydraulic sequencer is configured to actuate the second hydraulic cylinder 303 to further drop the drill stem segment into position within the drill stem vice 120. In this configuration, the use of two separate hydraulic cylinders 301, 303 in the linear actuator 302 provides two discrete distances along the range of motion 410. This configuration simplifies manufacturing in that a single linear actuator 302 is used for a two stem movement. This configuration simplifies operation, in that each hydraulic cylinder 301, 303 is actuated to full range, without the need for any encoders or other mechanical limiters to monitor the two discrete movements.

In the example shown, the drill stem gripper 310 is coupled to the linear actuator 302 by a linkage that is configured to move the drill stem gripper completely to one side of a drill stem during a retraction operation. In FIG. 4, axis 420 is shown to illustrate the path that a center of a drill stem segment travels during a loading or unloading operation. Axis 422 illustrates a side of the drill stem segment. In operation, when the drill stem gripper 310 is in a released condition, all portions of the drill stem gripper 310 are moved to the right side of axis 422 as illustrated in FIG. 4. This feature is described in more detail in the following FIGS. 5A-5D.

Figure 5A:
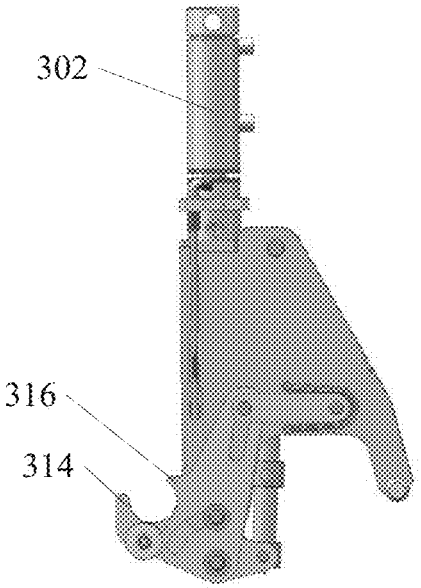
FIG. 5A-5D are views of portions of a drill stem loader in operation in accordance with some embodiments of the invention.
Figure 5B:
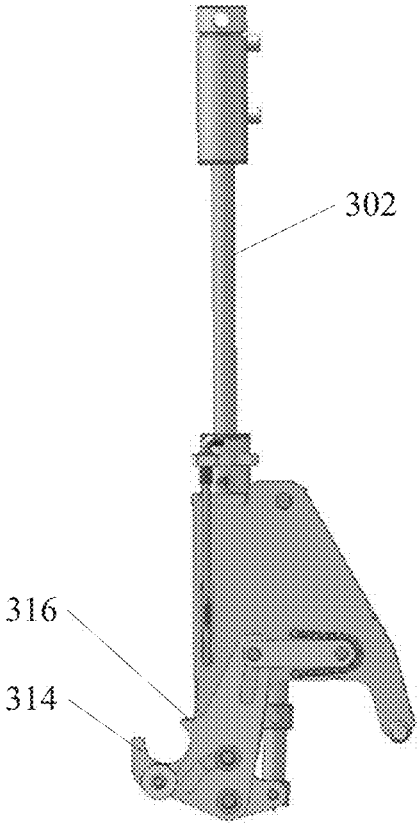

FIG. 5A shows the assembly 300 from FIG. 3 in a first condition that would be adjacent to the dispensing port 416 of the drill stem magazine 144. The linear actuator 302 is retracted, and the gripping jaws 314, 316 are closed, as they would be around a drill stem segment. FIG. 5B shows the assembly 300 in a second condition that would be adjacent to the gripping jaws 121 of the drill stem vice 120. The linear actuator 302 is extended, and the gripping jaws 314, 316 are closed, as they would be before releasing them to the drill stem vice 120.

Figure 5C:
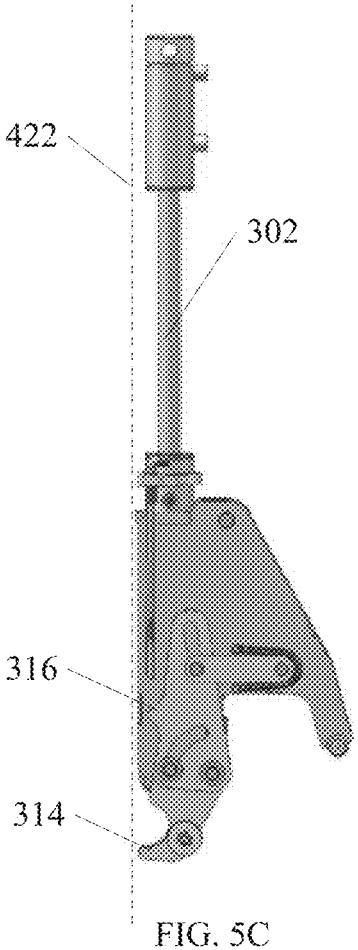
Figure 5D:
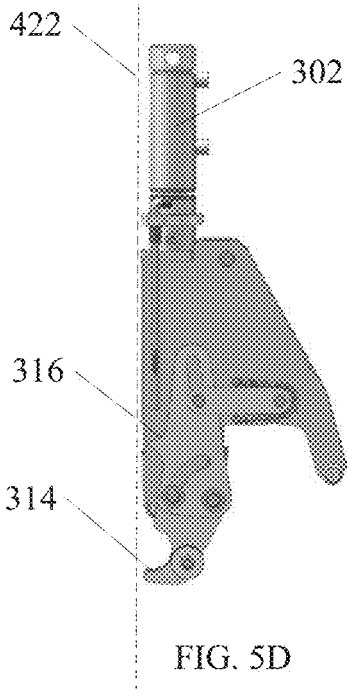

FIG. 5C shows the assembly 300 in a third condition that would be adjacent to the gripping jaws 121 of the drill stem vice 120. The linear actuator 302 is still extended, but the gripping jaws 314, 316 are now opened to release the drill stem segment. Line 422 from FIG. 4 has been included in FIG. 5C to illustrate that all portions of the drill stem gripper 310 are moved to the right side of axis 422, which represents one side of the drill stem. FIG. 5D shows the assembly 300 in a fourth condition that would be returned to adjacent to the dispensing port 416 of the drill stem magazine 144. The linear actuator 302 is again retracted. The gripping jaws 314, 316 are shown still in the opened condition. In one example of a drilling operation, the assembly 300 is then cycled back to FIG. 5A to pick and place another drill stem segment into the drill string. It will be appreciated that in a drill stem removal operation, these steps may be performed in reverse, with the removed drill stem segments being returned from the drill stem vice 120 and placed in the drill stem magazine 144.

Figure 6:
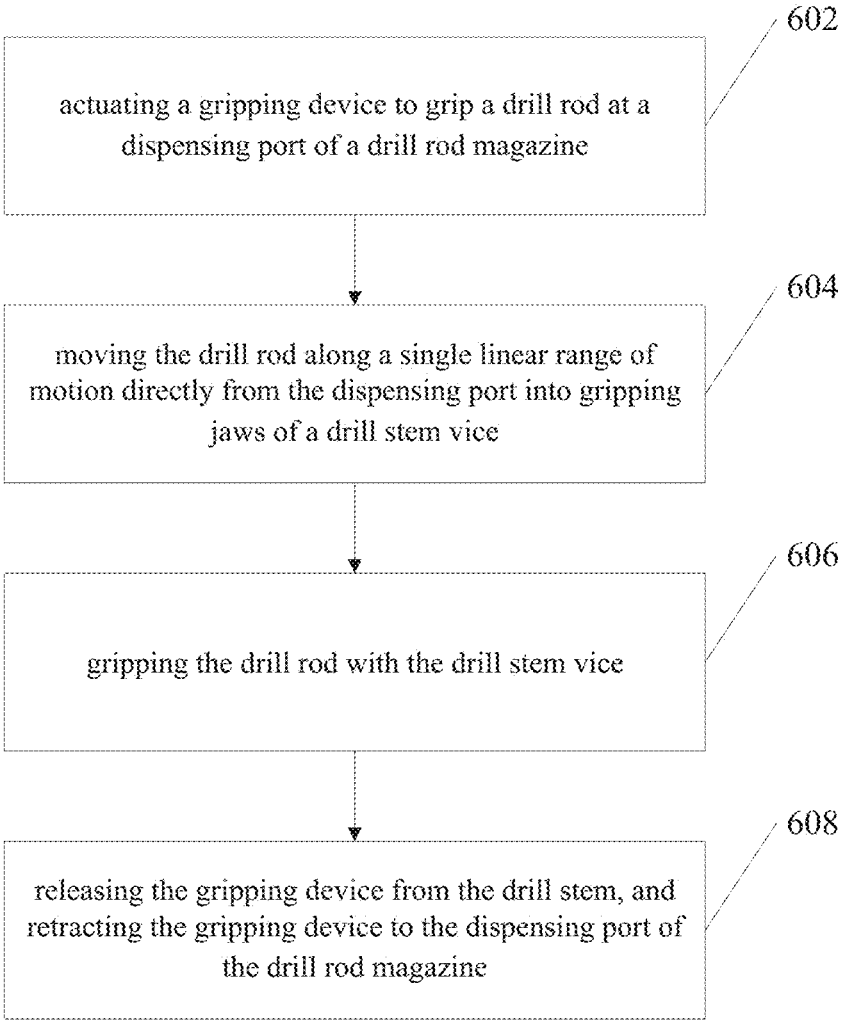
FIG. 6 is a flow diagram of a method of drill stem loading in accordance with some embodiments of the invention.

FIG. 6 shows a flow diagram of a method of operating a directional drill according to an embodiment of the invention. In operation 602, a gripping device is actuated to grip a drill stem at a dispensing port of a drill stem magazine. In operation 604, the drill stem is moved along a single linear range of motion directly from the dispensing port into gripping jaws of a drill stem vice. In operation 606, the drill stem is gripped with the drill stem vice. Lastly, in operation 608, the gripping device is released from the drill stem, and the gripping device is retracted to the dispensing port of the drill stem magazine.

To better illustrate the method and apparatuses disclosed herein, a non-limiting list of examples is provided here:

Example 1 includes a directional drill stem loader. The directional drill stem loader includes a drill stem magazine, a linear actuator, a drill stem vice, and a drill stem gripper coupled to the linear actuator. The drill stem gripper is adapted to hold a drill stem within a linear range of motion. A first end of the linear range of motion is directly beneath a dispensing port of the drill stem magazine, and a second end of the linear range of motion is within gripping jaws of the drill stem vice.

Example 2 includes the directional drill stem loader of example 1, wherein the linear actuator includes a hydraulic cylinder.

Example 3 includes the directional drill stem loader of any one of examples 1-2, wherein the linear range of motion is substantially vertical.

Example 4 includes the directional drill stem loader of any one of examples 1-3, wherein the drill stem gripper is adapted to support a drill stem from underneath the drill stem.

Example 5 includes the directional drill stem loader of any one of examples 1-4, wherein the drill stem gripper is coupled to the linear actuator by a linkage that is configured to move the drill stem gripper completely to one side of a drill stem during a retraction operation.

Example 6 includes the directional drill stem loader of any one of examples 1-5, wherein the drill stem gripper includes a single gripping actuator and wherein the linkage is configured to actuate opposable drill stem gripper jaw motion.

Example 7 includes the directional drill stem loader of any one of examples 1-6, wherein the loader includes a pair of linear actuators and drill stem grippers.

Example 8 includes the directional drill stem loader of any one of examples 1-7, wherein the linear actuator includes two hydraulic cylinders on either end of a common rod.

Example 9 includes the directional drill stem loader of any one of examples 8, wherein a first cylinder of the two hydraulic cylinders on either end of the common rod is configured to drop a drill stem segment by a distance equal to a diameter of a drill stem segment, and a second of the two hydraulic cylinders is configured to move the drill stem segment within gripping jaws of the drill stem vice.

Example 10 includes a directional drill. The directional drill includes a drill head mounted to a carriage frame along a movable track, a power supply coupled to the drill head and a directional drill stem loader. The directional drill stem loader includes a drill stem magazine, a linear actuator, a drill stem vice, and a drill stem gripper coupled to the linear actuator. The drill stem gripper is adapted to hold a drill stem within a linear range of motion wherein a first end of the linear range of motion is directly beneath a dispensing port of the drill stem magazine, and a second end of the linear range of motion is within gripping jaws of the drill stem vice.

Example 11 includes the directional drill of example 10, further including a track system to move and position the directional drill.

Example 12 includes the directional drill of any one of examples 10-11, further including a drill fluid supply system.

Example 13 includes the directional drill of any one of examples 10-12, wherein the dispensing port of the drill stem magazine is located over a center of the directional drill.

Example 14 includes a method of drill stem loading, including actuating a gripping device to grip a drill stem at a dispensing port of a drill stem magazine, moving the drill stem along a single linear range of motion directly from the dispensing port into gripping jaws of a drill stem vice, gripping the drill stem with the drill stem vice, and releasing the gripping device from the drill stem, and retracting the gripping device to the dispensing port of the drill stem magazine.

Example 15 includes the method of example 14, wherein actuating the gripping device includes gripping a drill stem from beneath, and wherein releasing the gripping device includes moving the gripping device away from beneath the drill stem to a side of the drill stem before retracting the gripping device to the dispensing port.

Example 16 includes the method of any one of examples 14-15, wherein actuating a gripping device includes actuating a single hydraulic cylinder coupled to a linkage that actuates opposable drill stem gripper jaws concurrently.

Example 17 includes the method of any one of examples 14-16, wherein moving the drill stem along the single linear range of motion includes moving the drill stem along a single vertical range of motion.

Example 18 includes the method of any one of examples 14-17, wherein only two actuation sequences are used during the drill stem loading operation.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A directional drill stem loader, comprising:

a drill stem magazine;

a linear actuator;

a drill stem vice including jaws to grip a drill stem by applying pressure to sides of the drill stem, the jaws defining a loading/unloading passageway; and a drill stem gripper coupled to the linear actuator, wherein the drill stem gripper is adapted to hold the drill stem within a linear range of motion and wherein the drill stem gripper includes a single hydraulic cylinder coupled to a linkage that actuates opposable drill stem gripper jaws concurrently;

wherein a first end of the linear range of motion is directly beneath a dispensing port of the drill stem magazine, and a second end of the linear range of motion is within the gripping jaws of the drill stem vice, and wherein the linear range of motion passes through the loading/unloading passageway in the drill stem vice.

2. The directional drill stem loader of claim 1, wherein the linear actuator includes a hydraulic cylinder.

3. The directional drill stem loader of claim 1, wherein the linear range of motion is substantially vertical.

4. The directional drill stem loader of claim 1, wherein the drill stem gripper is adapted to support the drill stem from underneath the drill stem.

5. The directional drill stem loader of claim 1, wherein the the linkage is configured to move the drill stem gripper completely to one side of the drill stem during a retraction operation.

6. The directional drill stem loader of claim 1, wherein the loader includes a pair of linear actuators and drill stem grippers.

7. The directional drill stem loader of claim 1, wherein the linear actuator includes two hydraulic cylinders with one of the two hydraulic cylinders on each opposing end of a common rod.

8. The directional drill stem loader of claim 7, wherein a first cylinder of the two hydraulic cylinders on either end of the common rod is configured to drop the drill stem segment by a distance equal to a diameter of the drill stem segment, and a second of the two hydraulic cylinders is configured to move the drill stem segment within gripping jaws of the drill stem vice.

9. A directional drill, comprising:

a drill head mounted to a carriage frame;

a power supply coupled to the drill head;

a directional drill stem loader, including:

a drill stem magazine;

a linear actuator;

a drill stem vice including jaws to grip a drill stem by applying pressure to sides of the drill stem, the jaws defining a loading/unloading passageway; and a drill stem gripper coupled to the linear actuator, wherein the drill stem gripper is adapted to hold the drill stem within a linear range of motion and wherein the drill stem gripper includes a single hydraulic cylinder coupled to a linkage that actuates opposable drill stem gripper jaws concurrently;

wherein a first end of the linear range of motion is directly beneath a dispensing port of the drill stem magazine, and a second end of the linear range of motion is within the gripping jaws of the drill stem vice, and wherein the linear range of motion passes through the loading/unloading passageway in the drill stem vice.

10. The directional drill of claim 9, further including a track system to move and position the directional drill.

11. The directional drill of claim 9, further including a drill fluid supply system.

12. The directional drill of claim 9, wherein the dispensing port of the drill stem magazine is located over a center of the directional drill.

13. A method of drill stem loading, comprising:

actuating a gripping device to grip a drill stem at a dispensing port of a drill stem magazine, wherein actuating the gripping device includes actuating a single hydraulic cylinder coupled to a linkage that actuates opposable drill stem gripper jaws concurrently;

moving the drill stem along a single linear range of motion directly from the dispensing port through a loading/unloading passageway into gripping jaws of a drill stem vice;

gripping the drill stem by applying pressure to the drill stem with the drill stem vice; and releasing the gripping device from the drill stem, and retracting the gripping device to the dispensing port of the drill stem magazine.

14. The method of claim 13, wherein actuating the gripping device includes gripping the drill stem from beneath, and wherein releasing the gripping device includes moving the gripping device away from beneath the drill stem to a side of the drill stem before retracting the gripping device to the dispensing port.

15. The method of claim 13, wherein the single linear range of motion is a single vertical range of motion.

16. The method of claim 13, wherein only two actuation sequences are used during the method of drill stem loading.

* * * * *